US009933218B2

(12) United States Patent
Butler

(10) Patent No.: US 9,933,218 B2
(45) **Date of Patent: *Apr. 3, 2018**

(54) FIREARM MAGAZINE LOADER AND METHOD OF USE

(71) Applicant: Charles Anders Butler, San Diego, CA (US)

(72) Inventor: Charles Anders Butler, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/597,008

(22) Filed: May 16, 2017

(65) Prior Publication Data

US 2017/0328658 A1 Nov. 16, 2017

Related U.S. Application Data

(63) Continuation-in-part of application No. 15/158,811, filed on May 19, 2016, now Pat. No. 9,683,798.

(60) Provisional application No. 62/245,158, filed on Oct. 22, 2015.

(51) Int. Cl.

| | |
|---|---|
| ***F41A 9/83*** | (2006.01) |
| ***F41A 9/64*** | (2006.01) |
| ***F42B 39/02*** | (2006.01) |

(52) U.S. Cl.

CPC *F41A 9/64* (2013.01); *F41A 9/83* (2013.01); *F42B 39/02* (2013.01)

(58) Field of Classification Search

CPC .... F41A 9/83; F41A 9/82; F42B 39/00; F42B 39/002

USPC ..... 42/87, 90; 224/196, 197, 198, 199, 200

See application file for complete search history.

(56) References Cited

U.S. PATENT DOCUMENTS

| | | | |
|---|---|---|---|
| 201,855 | A | 3/1878 | White |
| 202,613 | A | 4/1878 | White |
| 1,163,369 | A | 12/1915 | Ross |
| 4,081,115 | A | 3/1978 | White et al. |
| 4,120,109 | A | 10/1978 | Musgrave |
| 5,598,958 | A | 2/1997 | Ryan, III et al. |
| 5,641,102 | A | 6/1997 | Hellweg |

(Continued)

OTHER PUBLICATIONS

International Search Report and Written Opinion of the International Searching Authority Korean Intellectual Property Office for International Patent Application No. PCT/US2017/033038 dated Aug. 10, 2017.

*Primary Examiner* — Joshua E Freeman

(74) *Attorney, Agent, or Firm* — Procopio Cory Hargreaves and Savitch LLP

(57) ABSTRACT

A one hand firearm magazine loader for loading a firearm with a firearm magazine including a lower member includes a magazine support housing that terminates in a lower end in a receiving section; a firearm magazine support extending from the magazine support housing to retain the firearm magazine in a substantially vertical position; a rotating support rotatably received in the receiving section for rotation about a first axis between the substantially vertical position and an angled position; and a magazine receiving member carried by the rotating support, the magazine receiving member receiving the lower member of the firearm magazine, wherein the magazine receiving member is rotatably mounted to the rotating support for rotation about a second axis, substantially perpendicular to the first axis, of the firearm magazine with mounted firearm.

20 Claims, 13 Drawing Sheets

(56) References Cited

U.S. PATENT DOCUMENTS

| | | | | |
|---|---|---|---|---|
| 5,937,559 | A | 8/1999 | Jennen | |
| 6,050,464 | A * | 4/2000 | Ramsey, Sr. | F41A 9/61 206/3 |
| 6,154,997 | A | 12/2000 | Aluotto et al. | |
| 7,025,238 | B2 | 4/2006 | Hughes et al. | |
| 7,614,534 | B2 | 11/2009 | Veo et al. | |
| 7,780,048 | B2 | 4/2010 | Howell | |
| 8,555,538 | B2 | 10/2013 | Huffines | |
| 8,733,606 | B2 | 5/2014 | Felts | |
| 8,783,532 | B2 | 7/2014 | Gregory et al. | |
| 8,887,972 | B2 | 11/2014 | Solomon | |
| 9,182,205 | B2 | 11/2015 | Sitz | |
| 9,395,153 | B2 | 7/2016 | Bottrell | |
| 9,404,696 | B2 | 8/2016 | Karimullah et al. | |
| 9,683,798 | B2 * | 6/2017 | Butler | F41A 9/83 |
| 2006/0022007 | A1 | 2/2006 | Hughes et al. | |
| 2007/0278269 | A1 | 12/2007 | Rogers et al. | |
| 2010/0243690 | A1 | 9/2010 | Lerch | |
| 2010/0276463 | A1 | 11/2010 | Gregory et al. | |
| 2014/0041275 | A1 | 2/2014 | Herrington | |
| 2014/0082987 | A1 | 3/2014 | Boll et al. | |
| 2015/0219413 | A1 | 8/2015 | Karimullah et al. | |
| 2015/0362277 | A1 | 12/2015 | Frey | |
| 2016/0084606 | A1 | 3/2016 | Michal | |
| 2016/0109208 | A1 | 4/2016 | Bottrell | |

* cited by examiner

FIREARM MAGAZINE LOADER AND METHOD OF USE

CROSS-REFERENCE TO RELATED APPLICATIONS

This is a continuation-in-part application of U.S. nonprovisional patent application Ser. No. 15/158,811, filed May 19, 2016, which claims priority to provisional patent application No. 62/245,158 filed on Oct. 22, 2015, both of which are incorporated by reference herein

FIELD OF THE INVENTION

The present invention relates to tactical firearm loading devices.

BACKGROUND OF THE INVENTION

Existing conditions for loading a small firearm (hand gun) with one hand is implemented with various tactical maneuvers which is time consuming and at times slow and unsafe.

SUMMARY OF THE INVENTION

An aspect of the invention involves a one hand firearm magazine loader for loading a firearm with a firearm magazine. The one hand firearm magazine loader includes a lower member having a one-piece magazine support housing including a wall that terminates in a lower end in a receiving section; support arms extending laterally from the vertical wall for retaining a firearm magazine in a substantially vertical position, vertical position; a rotating support rotatably received in the receiving section for rotation about a first axis-between the substantially vertical position and an angled position; and a magazine receiving member carried by the rotating support, the magazine receiving member receiving the lower member of the firearm magazine.

One or more implementations of the aspect of invention described above includes one or more of the following: the magazine receiving member is rotatably mounted to a top of the rotating support for rotation about a second axis, different from the first axis, of the firearm magazine with mounted firearm; a ratchet mechanism between the magazine receiving member and the rotating support, creating a ratcheting effect when rotating the magazine receiving member substantially vertical positions relative to the rotating support; the magazine receiving member rotates about the second axis substantially vertical positions relative to the rotating cylinder; the magazine receiving member rotates about the first axis less than 90 degrees relative to the substantially vertical position; the magazine receiving member rotates about the first axis 60 degrees relative to the substantially vertical position; the magazine receiving member rotates about the first axis 45 degrees relative to the substantially vertical position; the firearm includes a handle with a bottom magazine receiving member includes top flanges having a thickness t that allow a bottom of the handle of the firearm to fully engage the firearm magazine so that the firearm magazine does not accidentally dislodge from the handle; the thickness t is no greater than 0.04 inches; the rotating support in conjunction with a bottom of the handle of the firearm, the rotating support, and the magazine receiving member including substantially similar dimensions enable the rotating support and the magazine receiving member to provide a sturdy, solid engagement structure to lock the firearm onto the firearm magazine.

Another aspect of the invention involves a method of using the one hand firearm magazine loader described above, comprising: providing the rotating support of the one hand firearm magazine loader at an angled position relative to the substantially vertical position; inserting a bottom of the firearm magazine into the magazine receiving member; rotating the rotating support, magazine receiving member and firearm magazine to the substantially vertical position; securing the rotating support, magazine receiving member and firearm magazine with the pair of support arms.

One or more implementations of the aspect of invention described immediately above includes one or more of the following: clipping the one hand firearm magazine loader to a support structure on the user with the clip of the one hand firearm magazine loader; using one hand, right or left, of the user and placing a barrel of the firearm onto the magazine with the rotating support, magazine receiving member and firearm magazine in the substantially vertical position until a bottom of the barrel is stopped by the pair of support arms; using the same hand of the user to rotate the rotating support, magazine receiving member, firearm magazine, and firearm away from the substantially vertical position and causing the barrel of the firearm to continue motion onto the firearm magazine so that the firearm magazine is fully inserted into the firearm; using the same hand of the user to move the firearm forward, sliding it off the magazine receiving member, locked and loaded ready to fire, all with the same hand; and/or rotating the magazine receiving member about the second axis relative to the rotating support and using the same hand of the user to move the firearm, sliding it off the magazine receiving member, locked and loaded ready to fire, all with the same hand.

An additional aspect of the invention involves a one hand firearm magazine loader for loading a firearm with a firearm magazine including a lower member includes a magazine support housing that terminates in a lower end in a receiving section; a firearm magazine support extending from the magazine support housing to retain the firearm magazine in a substantially vertical position; a rotating support rotatably received in the receiving section for rotation about a first axis between the substantially vertical position and an angled position; and a magazine receiving member carried by the rotating support, the magazine receiving member receiving the lower member of the firearm magazine, wherein the magazine receiving member is rotatably mounted to the rotating support for rotation about a second axis, substantially perpendicular to the first axis, of the firearm magazine with mounted firearm.

One or more implementations of the aspect of invention described immediately above includes one or more of the following: a ratchet mechanism between the magazine receiving member and the rotating support, creating a ratcheting effect when rotating the magazine receiving member; the magazine receiving member rotates about the second axis to a downwardly angled position relative to the rotating support; the magazine receiving member includes top flanges having a thickness t that allow a bottom of a handle of the firearm to fully engage the firearm magazine so that the firearm magazine does not accidentally dislodge from the handle, and the thickness t is no greater than 0.04 inches; the firearm magazine support is spaced a distance H from the magazine receiving member to ensure sufficient momentum when loading the firearm with the firearm magazine, and the distance H is at least 1 3/16 inches; a biasing mechanism urges the rotating support to the vertical position; a duty belt connecting plate with a plurality of one hand firearm magazine loader coupling areas to couple a pair of one hand firearm magazine loaders to the duty belt connecting plate in a side-by-side arrangement; the side-by-side arrangement includes the pair of one hand firearm magazine loaders staggered at different heights; the side-by-side arrangement includes the pair of one hand firearm magazine loaders oriented at angles relative to vertical; a removable download cover that removably covers the firearm magazine and couples to the one hand firearm magazine loader; the removable download cover and one hand firearm magazine loader include a snap-on coupling to couple the removable download cover to the one hand firearm magazine loader; and/or the removable download cover includes a lip section that is configured to be engaged by a handle of the firearm for removing the removable download cover.

A still further aspect of the invention involves a method of using a one hand firearm magazine loader for loading a firearm with a firearm magazine including a lower member, the one hand firearm magazine loader comprising magazine support housing that terminates in a lower end in a receiving section, a firearm magazine support extending from the magazine support housing to retain the firearm magazine in a substantially vertical position, a rotating support rotatably received in the receiving section for rotation about a first axis between the substantially vertical position and an angled position, a magazine receiving member carried by the rotating support, the magazine receiving member receiving the lower member of the firearm magazine, wherein the magazine receiving member is rotatably mounted to the rotating support for rotation about a second axis, substantially perpendicular to the first axis, of the firearm magazine with mounted firearm, comprising using one hand, right or left, and placing a barrel of the firearm onto the magazine with the rotating support, magazine receiving member and firearm magazine in the substantially vertical position until a bottom of the barrel is stopped by the firearm magazine support; using the same hand to rotate the rotating support, magazine receiving member, firearm magazine, and firearm away from the substantially vertical position; moving the barrel of the firearm onto the firearm magazine so that the firearm magazine is fully inserted into the firearm; using the same hand to rotate the magazine receiving member about the second axis relative to the rotating support and move the firearm, sliding it off the magazine receiving member, locked and loaded ready to fire, all with the same hand.

One or more implementations of the aspect of invention described immediately above includes one or more of the following: using the same hand includes rotating the magazine receiving member about the second axis relative to the rotating support to a downwardly angled position relative to the rotating support; a biasing mechanism that urges the rotating support to the vertical position, and the method further includes urging the rotating support to the vertical position with the biasing mechanism; a duty belt connecting plate with a plurality of one hand firearm magazine loader coupling areas to couple a pair of one hand firearm magazine loaders to the duty belt connecting plate in a side-by-side arrangement, and method includes performing the method successively with each side-by-side one hand firearm magazine loader; the side-by-side arrangement includes the pair of one hand firearm magazine loaders are staggered at different heights, and method includes performing the method successively with each staggered height one hand firearm magazine loader; the pair of one hand firearm magazine loaders are oriented at angles relative to vertical, and method includes performing the method successively with each angled one hand firearm magazine loader; g a removable download cover that removably covers the firearm magazine and couples to the one hand firearm magazine loader, and the method includes covering the firearm magazine and coupling to the one hand firearm magazine loader with the removable download cover; and/or the removable download cover includes a lip section that is configured to be engaged by a handle of the firearm for removing the removable download cover, and the method includes engaging the lip section of the removable download cover with the handle of the firearm and removing the removable download cover.

DETAILED DESCRIPTION OF EMBODIMENTS OF INVENTION

Figure 1A:
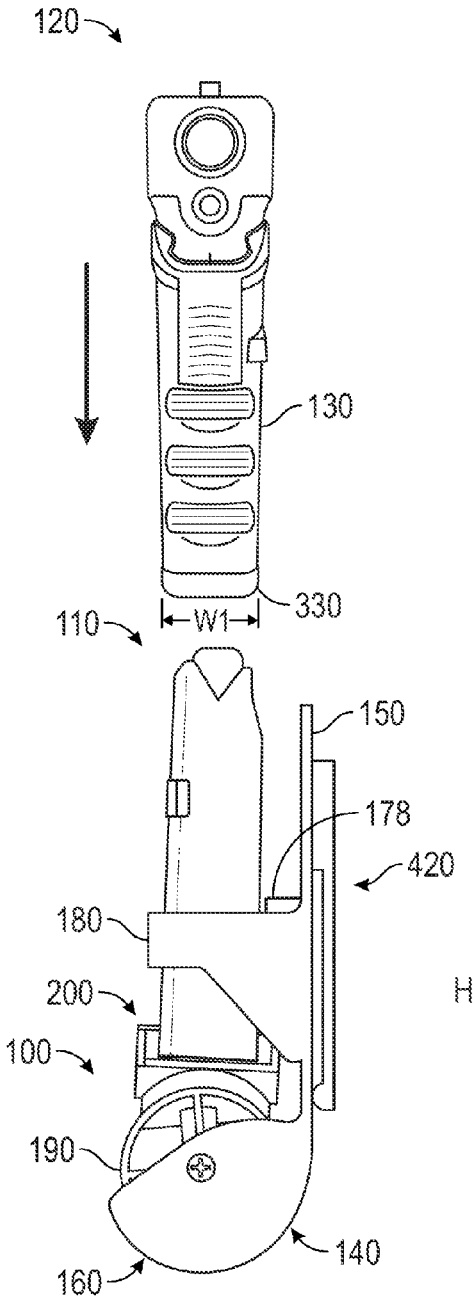
FIG. 1A is a front elevational view of an embodiment of a tactical firearm loading device and shows a firearm magazine loaded in the tactical firearm loading device in a secured up-right, 90 degree position, ready for use, and a firearm above the loaded firearm magazine.

With reference to FIGS. 1A to 2B, an embodiment of a rapid tactical one hand firearm magazine loader ("firearm magazine loader") 100 for right-handed firearm users will be described. The firearm magazine loader 100 is shown with a firearm magazine 110 loaded in the tactical firearm loading device 100 and with a firearm (e.g., hand gun) 120 having a hollow handle 130 that the firearm magazine 110 is loaded into using the firearm magazine loader 100.

The firearm magazine loader 100 includes a one-piece magazine support housing 140 including a vertical wall 150 that terminates in a lower end in a rotating cylinder receiving section 160. A support block member 178 and a pair of support arms 180 extend laterally from the vertical wall 150 for retaining the firearm magazine 110 in the substantially vertical position vertical position shown in FIGS. 1A and 1B.

Figure 1B:
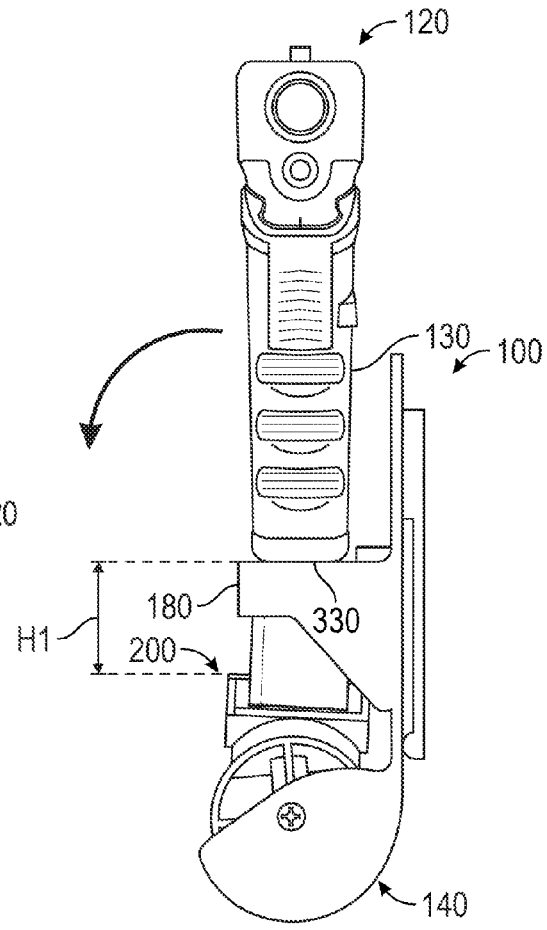
FIG. 1B is a front elevational view similar to FIG. 1A and shows the firearm magazine partially loaded into a handle of the firearm.
Figure 2A:
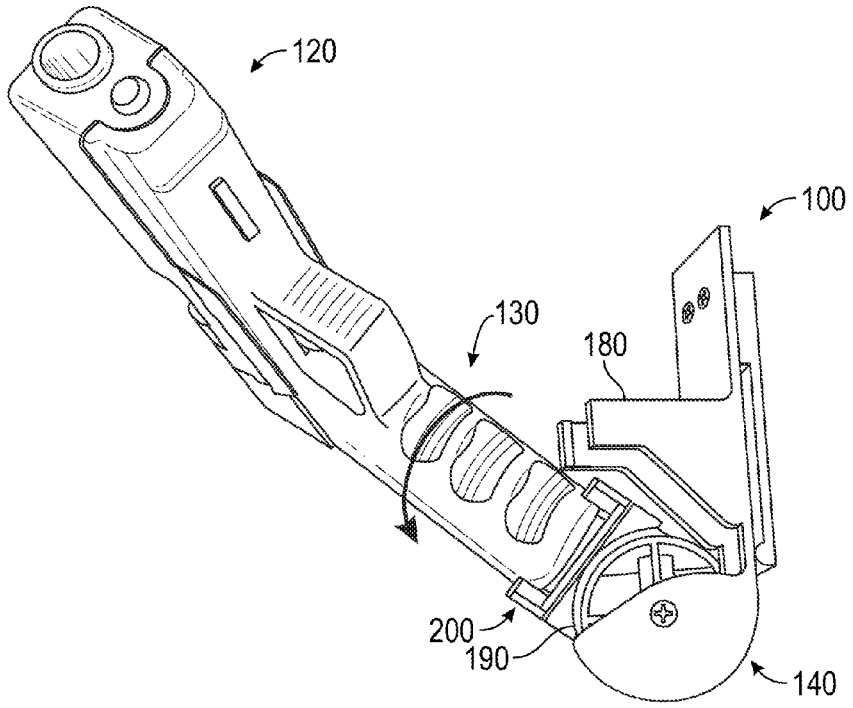
FIG. 2A is a perspective view of the tactical firearm loading device with loaded firearm magazine and firearm shown rotated to a 45 degree position via a rotating cylinder and with the firearm magazine completely loaded into the handle of the firearm.

A rotating cylinder or rotating support 190 with dimensions W3, L3 is rotatably received in the rotating cylinder receiving section 160 for rotation about a first axis 192 of the firearm magazine 110 with mounted firearm 120 between the substantially vertical, substantially vertical position shown in FIGS. 1A, 1B, and the forty five degree position shown in FIGS. 2A and 2D. In a preferred embodiment, the magazine receiving member rotates with the rotating support about the first axis less than 90 degrees relative to the substantially vertical position. In a more preferred embodiment, the magazine receiving member rotates with the rotating support about the first axis 60 degrees relative to the substantially vertical position. In a most preferred embodiment, the magazine receiving member rotates with the rotating support about the first axis 45 degrees relative to the substantially vertical position.

A magazine receiving plate or member 200 with dimensions W2, L2 slidably receives lower member 210 of the firearm magazine 110. The magazine receiving plate 200 is rotatably mounted to a top of the rotating cylinder 190 for rotation about a second axis 212 of the firearm magazine 110 with mounted firearm 120 substantially vertical positions (FIG. 2B) relative to the position of the magazine receiving plate 200, firearm magazine 110, and mounted firearm 120 in FIG. 2A.

Figure 3:
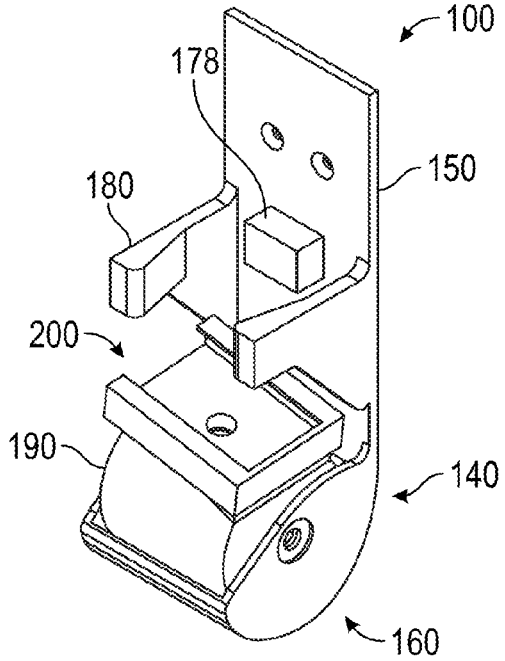
FIG. 3 is a perspective view of another embodiment of a tactical firearm loading device.
Figure 4A:
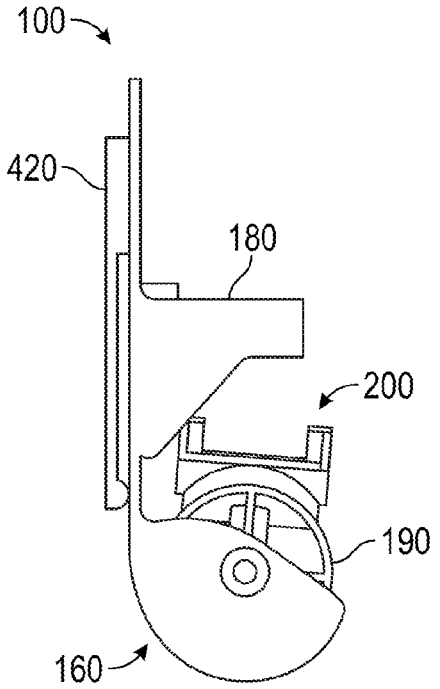
FIG. 4A is a front elevational view of the embodiment of the tactical firearm loading device shown in FIG. 3.
Figure 4B:
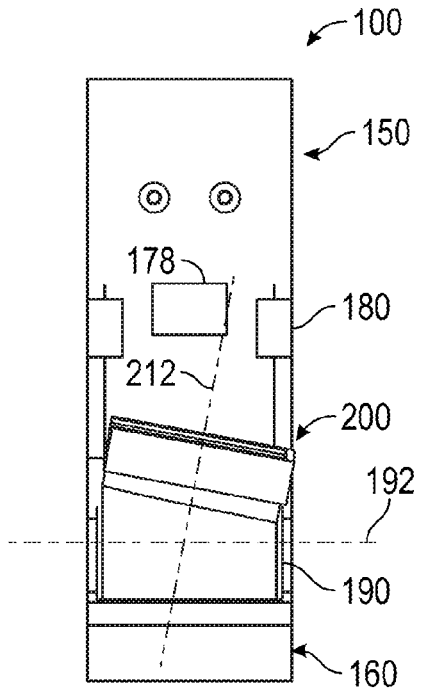
FIG. 4B is a right elevational view of the embodiment of the tactical firearm loading device shown in FIG. 3.
Figure 5:
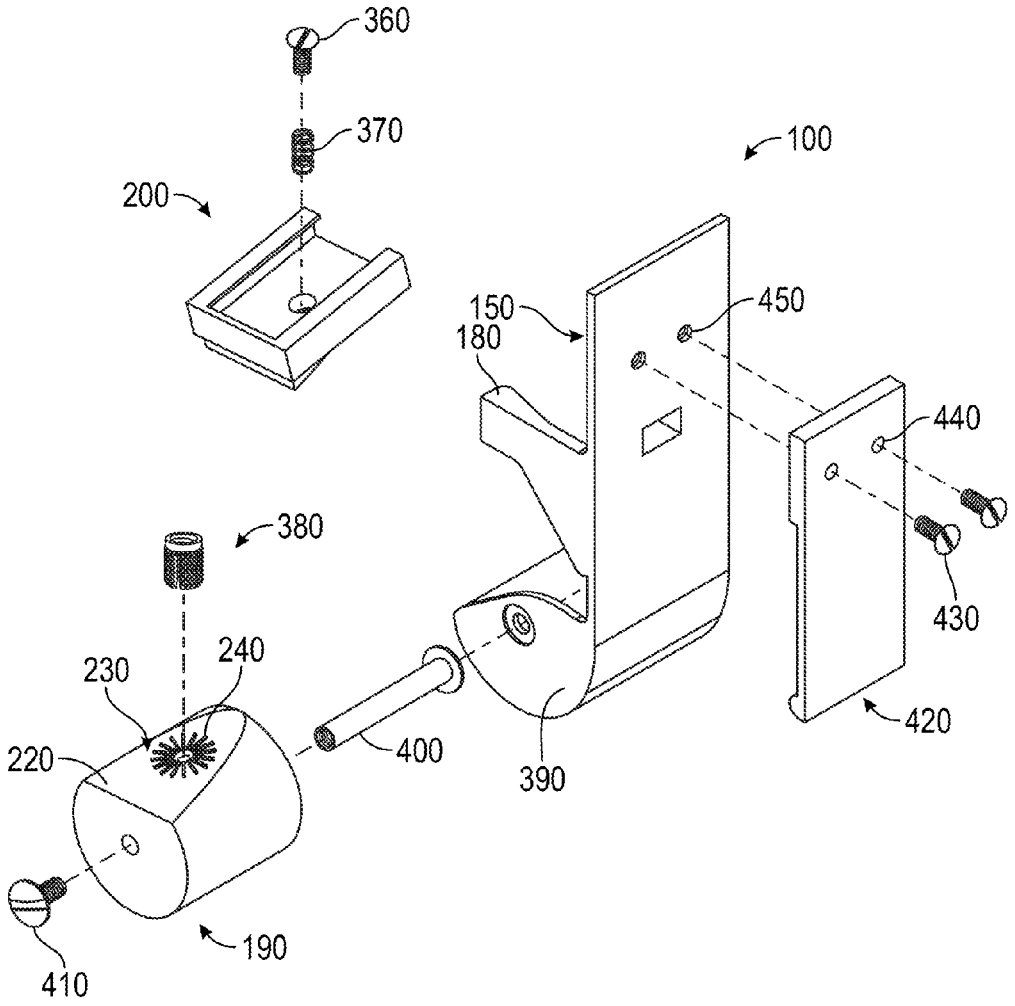
FIG. 5 is an exploded perspective view of the embodiment of the tactical firearm loading device shown in FIG. 3.
Figure 6A:
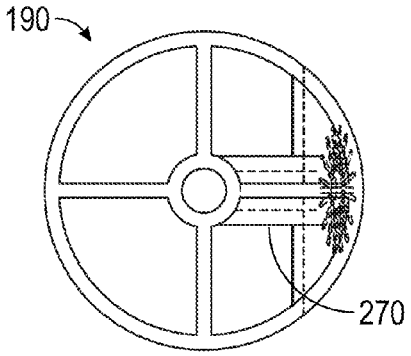
FIGS. 6A, 6B, 6C, 6D are end, perspective, side, and top views of an embodiment of a rotating cylinder or rotating support of the tactical firearm loading device.
Figure 6B:
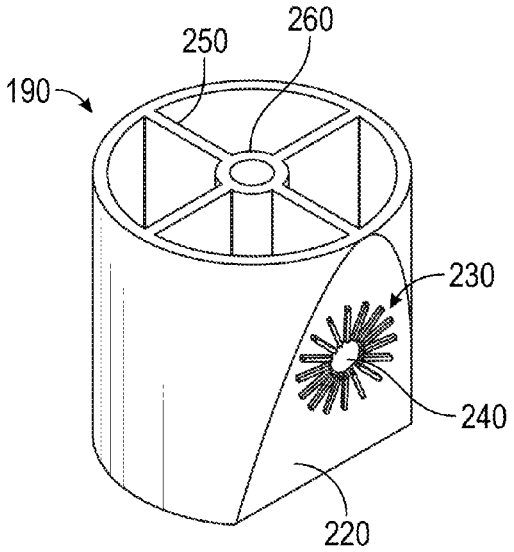
Figure 6C:
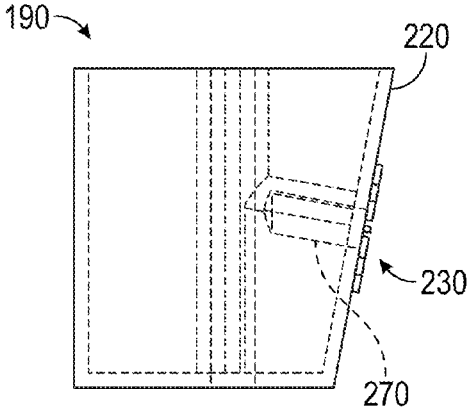
Figure 6D:
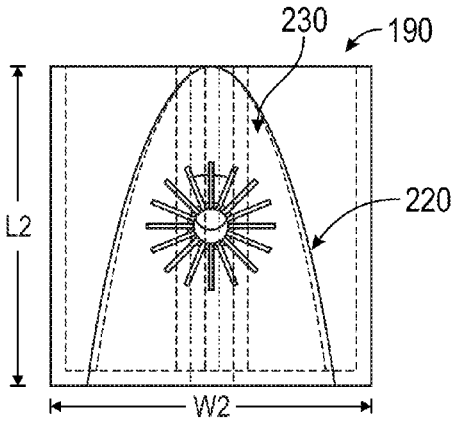
Figure 7A:
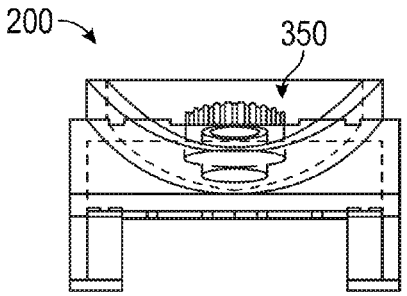
FIGS. 7A, 7B, 7C, 7D are end, perspective, side, and top views of an embodiment of a magazine receiving plate of the tactical firearm loading device.
Figure 7B:
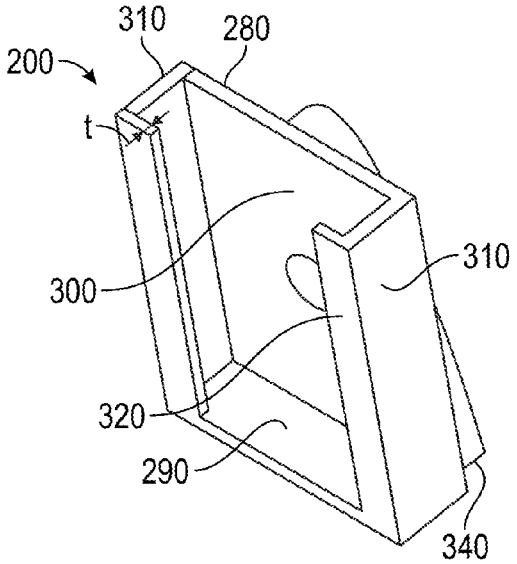
Figure 7C:
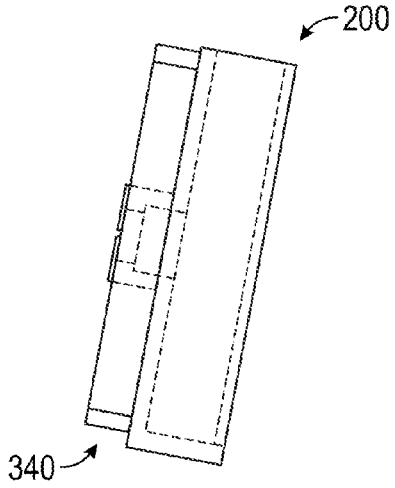
Figure 7D:
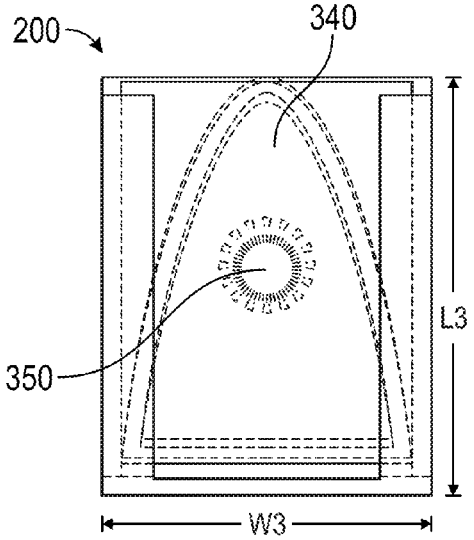
Figure 8:
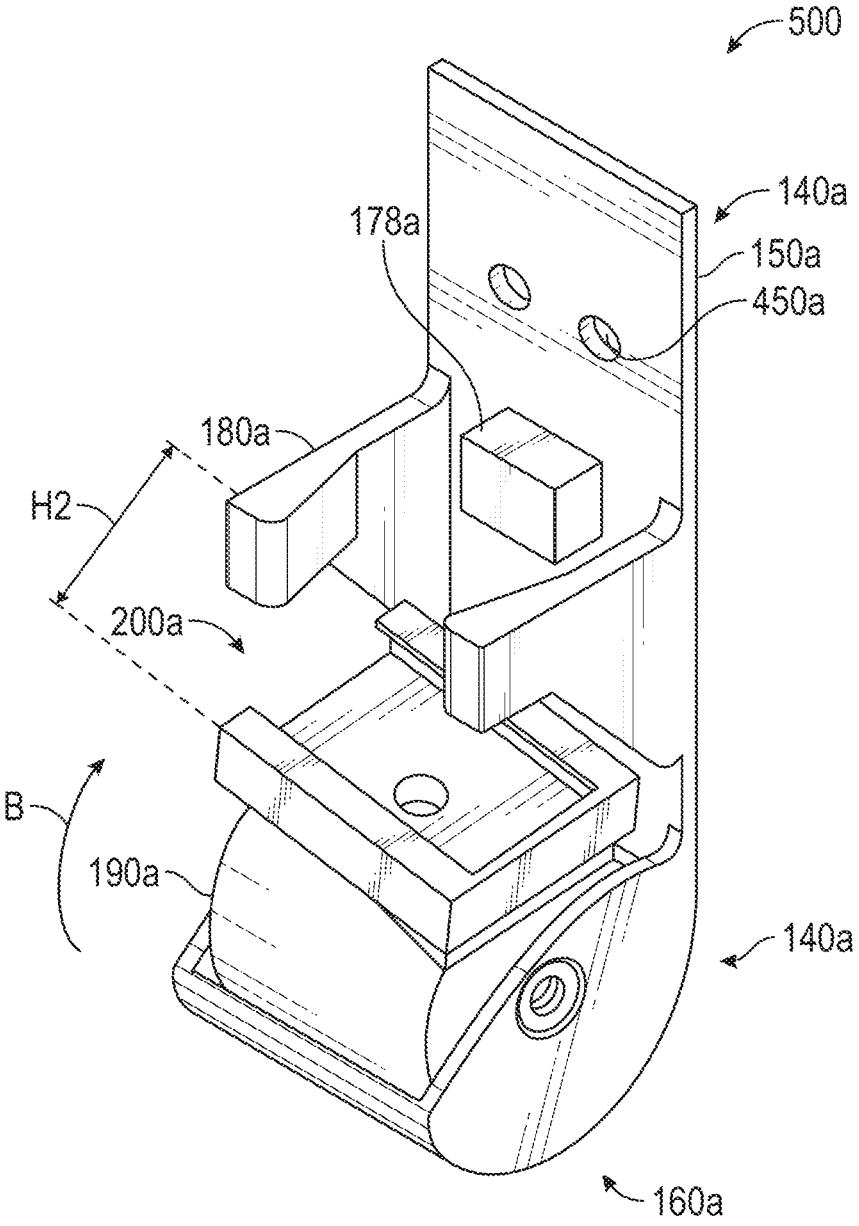
FIG. 8 is perspective view of another embodiment of a tactical firearm loading device.
Figure 9:
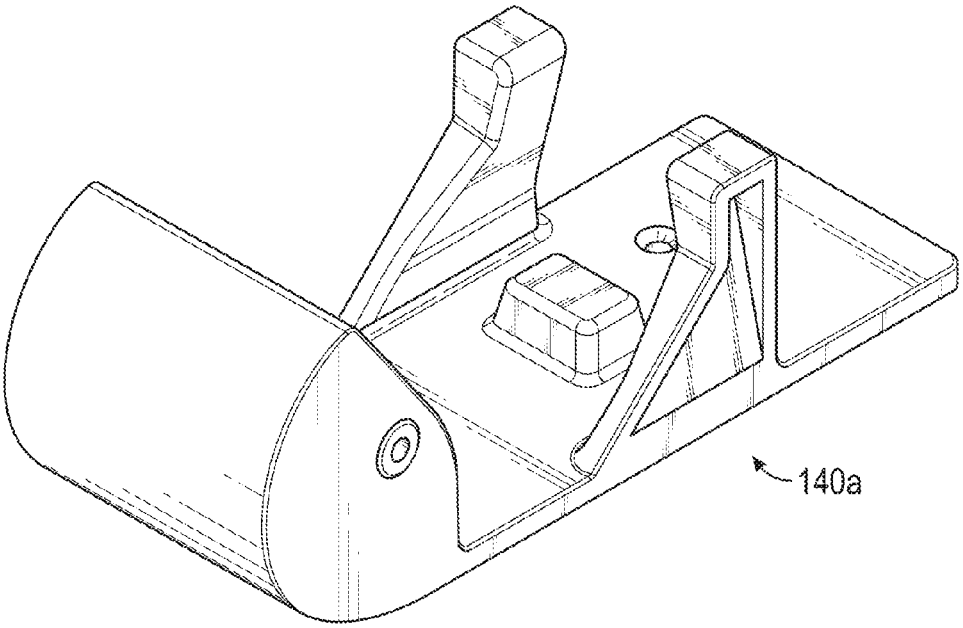
FIG. 9 is perspective view of a one-piece magazine support housing of the tactical firearm loading device of FIG. 8.
Figure 10A:
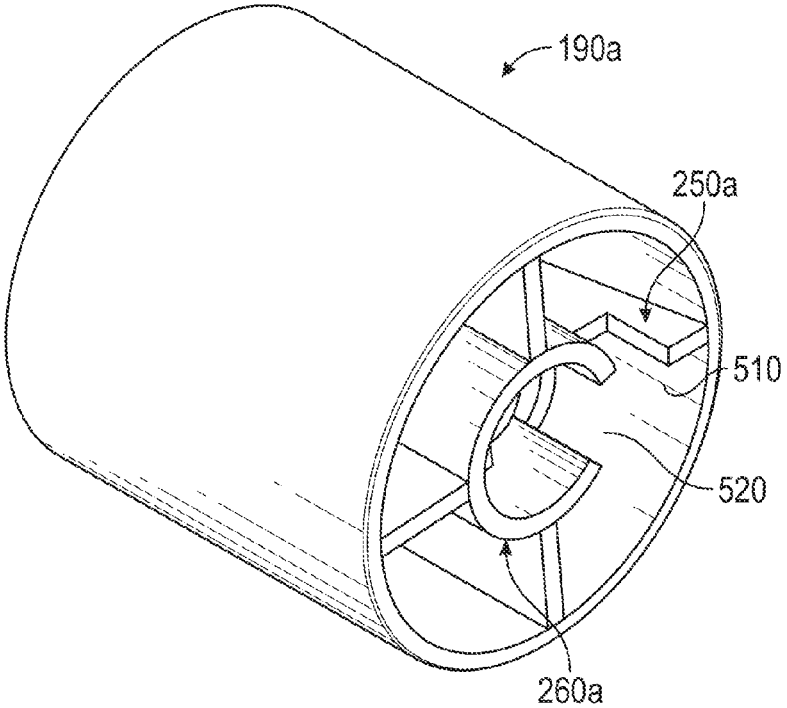
FIG. 10A is perspective view of a rotating cylinder/support of the tactical firearm loading device of FIG. 8.
Figure 10B:
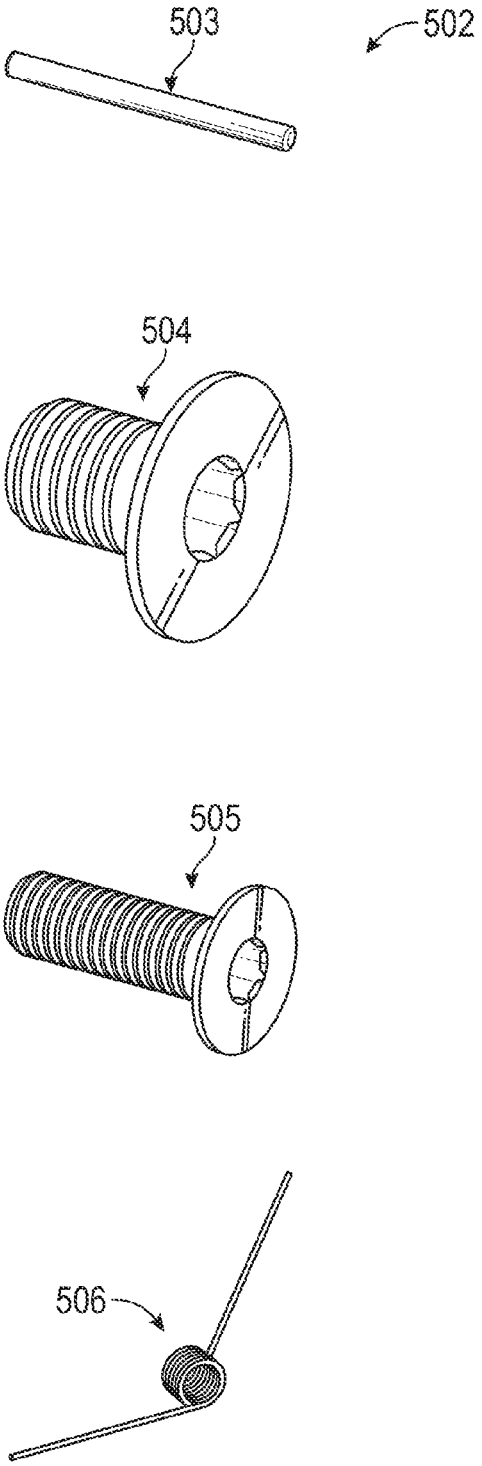
FIG. 10B is biasing mechanism for the rotating cylinder/support of FIG. 10A.
Figure 11:
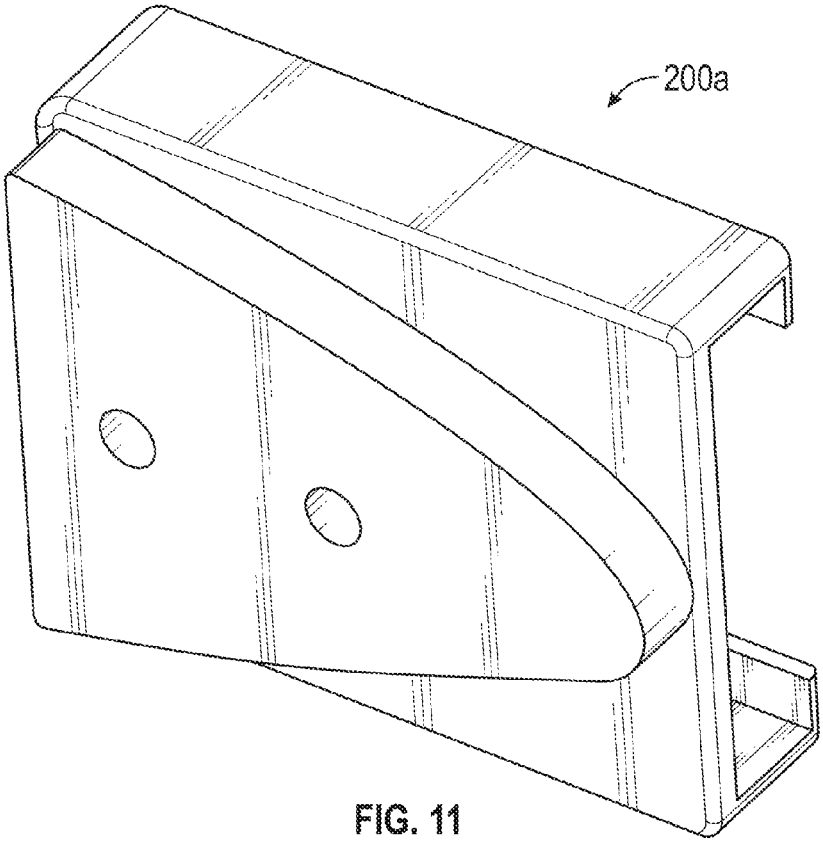
FIG. 11 is perspective view of a magazine receiving plate/member of the tactical firearm loading device of FIG. 8.
Figure 12:
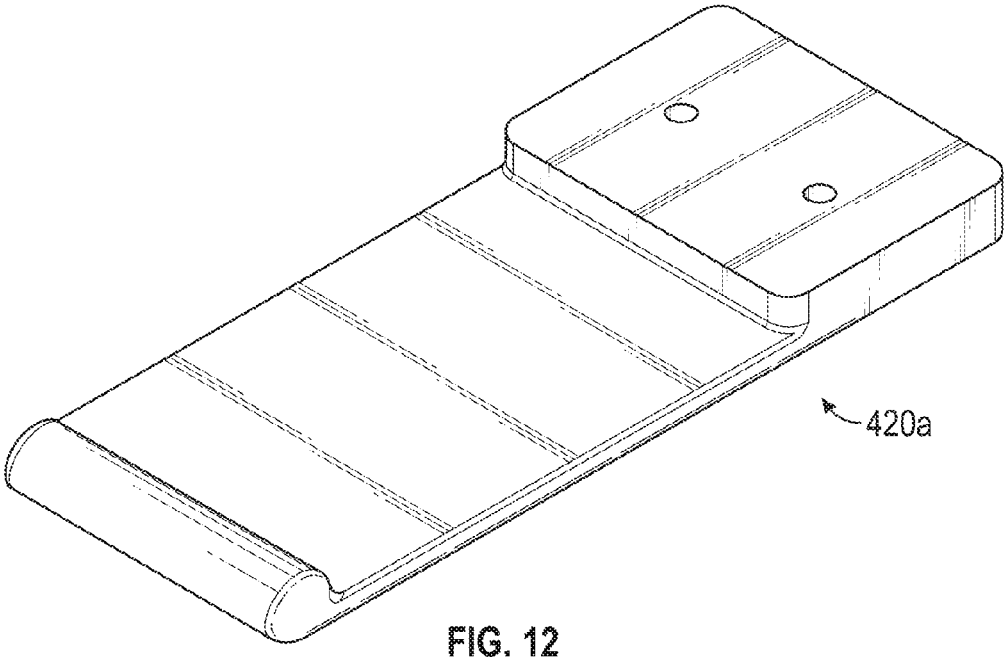
FIG. 12 is perspective view of a clip of the tactical firearm loading device of FIG. 8.

With reference additionally to FIGS. 3-5, which shows a firearm magazine loader 100 for left-handed firearm users, further aspects of the firearm magazine loader 100 will be described.

The rotating cylinder 190 includes a substantially hollow and cylindrical construction with an inclined substantially triangular support face 220. The support face 220 includes a sunburst pattern of ridges 230 and hole 240 therein. The rotating cylinder 190 includes internal walls 250 and a pin receiving cylindrical member 260. An internally threaded cylindrical member 270 defines the hole 240.

Figure 2B:
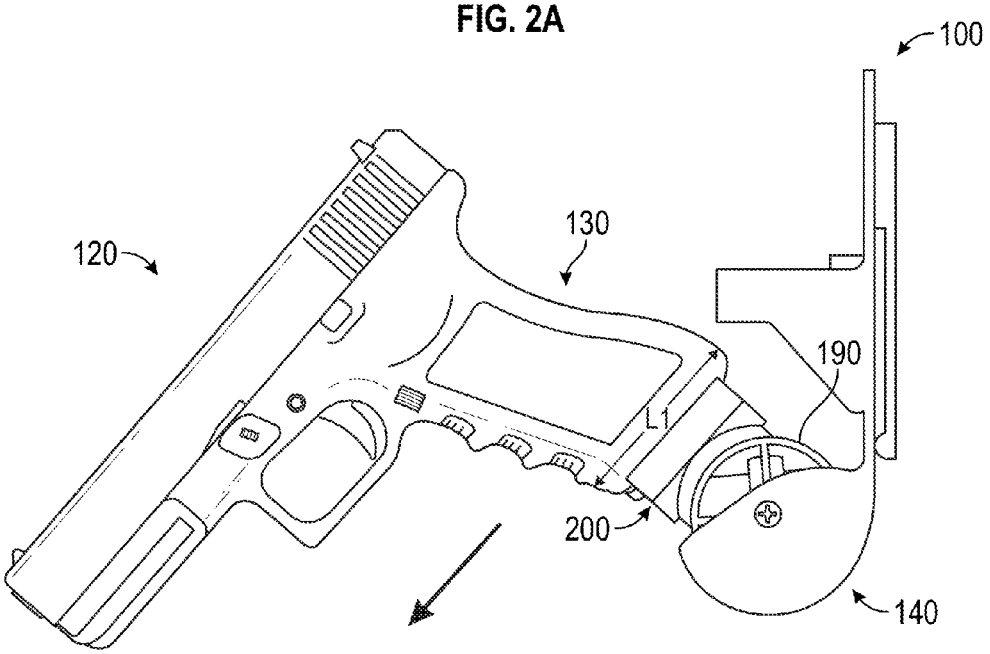
FIG. 2B is a perspective view of the tactical firearm loading device with loaded firearm magazine and firearm shown rotated to a 45 degree position via a rotating cylinder and with the firearm shown rotated 90 degrees via a rotating plate.

The plate 200 has a substantially rectangular configuration an includes a bottom wall 280, end wall 290, opposite open end 300, and side walls 310. Thin top flanges 320 extend laterally inward from side walls 310. The thin top flanges 320 have a thickness t, in a preferred embodiment, of no greater than 0.04 inches so that a bottom/end 330 of the handle 130 of the firearm 120 can fully engage the firearm magazine 110 (so that the firearm magazine 110 does not dislodge from the handle 130) while allowing the firearm magazine 110 with mounted firearm 120 to easily slide off of the plate 200. In a more preferred embodiment, the thickness t is 0.04 inches. A bottom of the plate 200 includes a substantially triangular support face 340 with a sunburst ratchet pattern 350 that cooperates with the sunburst pattern of ridges 230 of the support face 220 of the rotating cylinder 190 for creating a ratcheting effect when rotating the plate 200 substantially vertical positions relative to the rotating cylinder 190 as shown in FIGS. 2A and 2B. The plate 200 is rotatably mounted to the rotating cylinder 190 via plate fastener 360, vertical spring 370, and bushing 380.

The rotating cylinder 190 is rotatably mounted to end walls 390 of the rotating cylinder receiving section 160 via support pin 400 and rotating cylinder fastener 410.

A clip 420 is mounted to a rear of the wall 150 of the magazine support housing 140 via clip fasteners 430 that extend through holes 440 and are threadably engaged in internally threaded sections 450.

The firearm magazine loader 100 will now be described in use. Prior to clipping the firearm magazine loader 100 to one's duty belt or pants, the user will place the loaded firearm magazine 110 into the plate 200 by positioning the firearm magazine loader 100 with the rotating cylinder rotated to the forty five degree position/configuration shown in FIG. 2A or 2B. The firearm magazine 110 is secured onto the rotating cylinder 190 by sliding a bottom of the firearm magazine 110 into the plate 200. Once the firearm magazine 110 is secured onto the cylinder rotating cylinder 190 via the plate 200, the user will push the firearm magazine 110, causing rotation of the rotating cylinder 190, into the magazine support housing 140, snapping/clipping it into position at a substantially vertical position angle/position shown in FIG. 1A, secured in that position by the support arms 180. These simple steps make the device ready for use. The firearm magazine loader 100 is then clipped via the clip 420 to the person's duty belt, pants, etc. (e.g., user's waist/mid anatomy).

When a user is ready to load the firearm magazine 110 into the hollow handle 130 of the firearm 120, using one hand, right or left, the user will place their firearm 120 emptied of the firearm magazine onto the top portion of the secured firearm magazine 110 (at its substantially vertical position as shown in FIG. 1A) sliding the firearm 120 downward until the downward motion stops, the bottom 330 of the firearm 120 abutting and stopped by a top of the support arms 180 as shown in FIG. 1B. Then, once the firearm 120 has reached its stopping point, the user completes the loading magazine process by pulling the firearm 120 out and away from the magazine support housing 140 and one's body, causing rotation via the rotating cylinder 190 of the firearm 120 with partially loaded firearm magazine 110 to the forty five degree position shown in FIG. 2A and allowing the firearm 120 to continue its downward motion onto the firearm magazine 110 so that the firearm magazine 110 is fully inserted into the firearm 120. As mentioned above, the thin top flanges 320 have a thickness t that allow a bottom 330 of the handle 130 of the firearm 120 to fully engage the firearm magazine 110 (so that the firearm magazine 110 does not dislodge from the handle 130). The user will now pull the firearm 120 forward, sliding it off the plate 200 on the rotating cylinder 190, locked and loaded ready to fire, all with one hand. The firearm magazine 110 with mounted firearm 120 easily slides forward, off of the plate 200.

Alternatively, if the user is in a space-restricted, tight situation/scenario where the firearm magazine 110 with mounted firearm 120 is not able to be slid forward, off of the plate 200, the user rotates the plate 200 substantially vertical positions relative to the rotating cylinder 190 via the rotating ratchet mechanism to the position shown in FIG. 2B. In this rotated position, the firearm magazine 110 with mounted firearm 120 easily slides forward, off of the plate 200 so that the loaded firearm 120 is ready for use.

Advantages of the firearm magazine loader 100 include: the one hand tactical firearm loading device 100 eliminates having to utilize the various tactical maneuvers making the reloading of the firearm 120 with one hand safer and faster; the one hand tactical firearm loading device 100 enables the user to maintain a visual on all surrounding activities and reload the firearm 120 with one hand in a safe and extremely fast method; the rotating cylinder/support 190 of the one hand tactical firearm loading device 100 in conjunction with substantially similar dimensions W2, L2 and W3, L3 of the rotating cylinder/support 190 and the plate 200, respectively, compared to the dimensions W1, L1 of the bottom/end 330 of the handle 130, enable the rotating cylinder/support 190 and the magazine receiving member/plate 200 to provide a sturdy, solid engagement structure to lock the firearm onto the firearm magazine; and/or the one hand tactical firearm loading device 100 enables a user in a space-restricted, tight situation/scenario, where the firearm magazine 110 with mounted firearm 120 is not able to be slid forward, off of the plate 200, to rotate the firearm magazine 110 with mounted firearm 120 substantially vertical positions to allow the user to slide the firearm magazine 110 with mounted firearm 120 laterally relative to the firearm magazine loader 100, off of the plate 200. Another advantage of the firearm magazine loader 100 is that it allows for flashlight tactical holding technics. There are several ways of holding a flashlight with one hand while the other hand occupies the firearm. While shining the light in front of one's activities, shooting and having to reload present the problem of now placing the flashlight back into its holder or elsewhere on your person and then reloading the firearm with both hands. By doing this, one now loses sight of the activities around you. With the one-hand firearm magazine loader 100, a user/shooter can reload with one hand while maintaining Illumination, presenting a safer condition for the user/shooter, and a faster firearm load.

With reference to FIGS. 8-12, another embodiment of a firearm magazine loader 500 will be described. Similar elements between the firearm magazine loader 500 and the firearm magazine loader 100 will be shown in FIGS. 8-12 with like reference numbers, but with an "a" suffix. The above description of the firearm magazine loader 100 and use is incorporated herein. The firearm magazine loader 500 is similar to the firearm magazine loader 100, except that a top of the support arms 180*a* are separated a greater distance/height H2 (at least 1 3/16 inches) relative to magazine receiving plate or member 200*a* in the firearm magazine loader 500 compared to the distance/height H1 with firearm magazine loader 100 (FIG. 1B). This additional distance/height in H2 in the firearm magazine loader 500 allows the user to impart greater momentum with the firearm 120 when moving the firearm 120 downward/onto the firearm magazine 110, improving the complete loading of the firearm magazine 110 into the firearm 120. With reference to FIGS. 10A and 10B, another addition in the firearm magazine loader 500 is a biasing mechanism 502 including slotted spring pin 503, screws 504, 505, and torsion spring 506 incorporated into the one-piece magazine support housing 140*a* and rotating cylinder or rotating support 190*a*. The biasing mechanism 502 biases/urges the rotating cylinder/support 190*a* and magazine receiving plate/member 200 to rotate in the direction B shown back to a home position shown in FIG. 8, where the receiving plate/member 200 is disposed under the support arms 180*a*. FIG. 10A shows notches 510, 520 in the internal wall 250*a* and pin receiving cylindrical member 260*a* for receiving the slotted spring pin 503 and the torsion spring 506. The addition of this spring-loaded rotating cylinder/support 190*a* eliminates the need for the user to manually move the rotating cylinder/support 190*a* into the home position after each use and maintains the rotating cylinder/support 190*a* in the home position.

Figure 13:
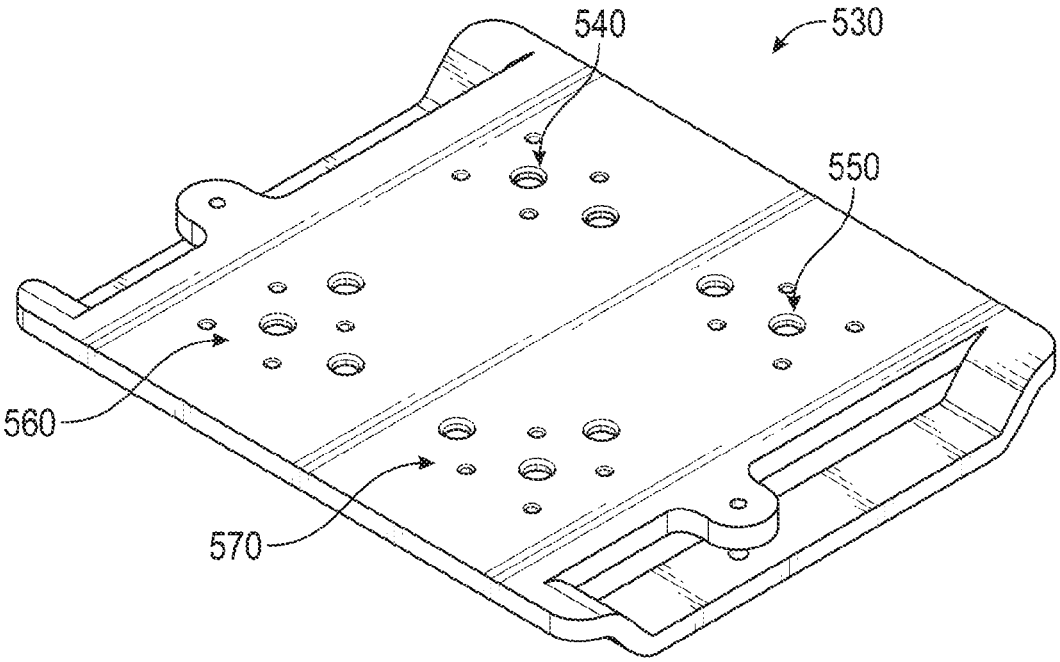
FIG. 13 is perspective view of a duty belt connecting plate for holding a pair of tactical firearm loading devices in a side-by-side arrangement.
Figure 14:
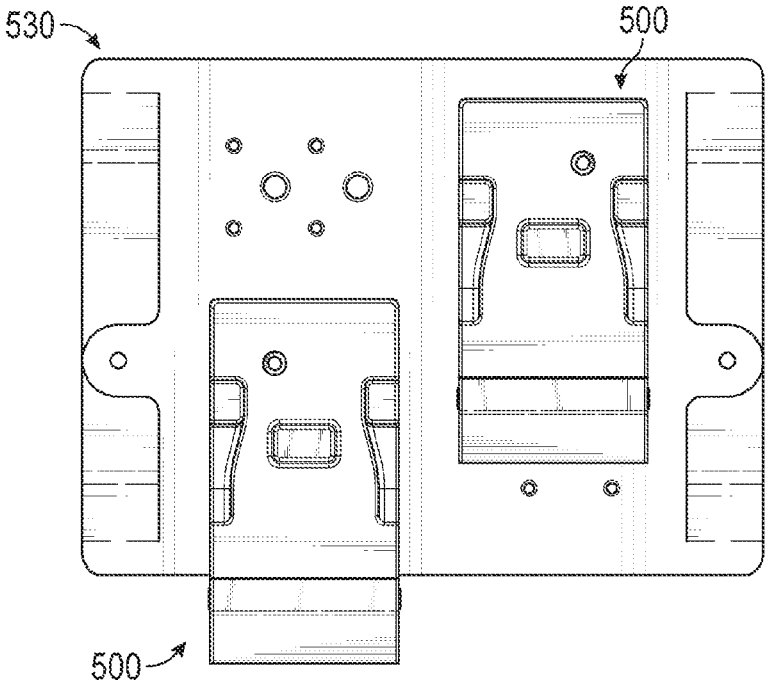
FIGS. 14 and 15 show exemplary side-by-side arrangements for holding pair of tactical firearm loading devices with the duty belt connecting plate.
Figure 15:
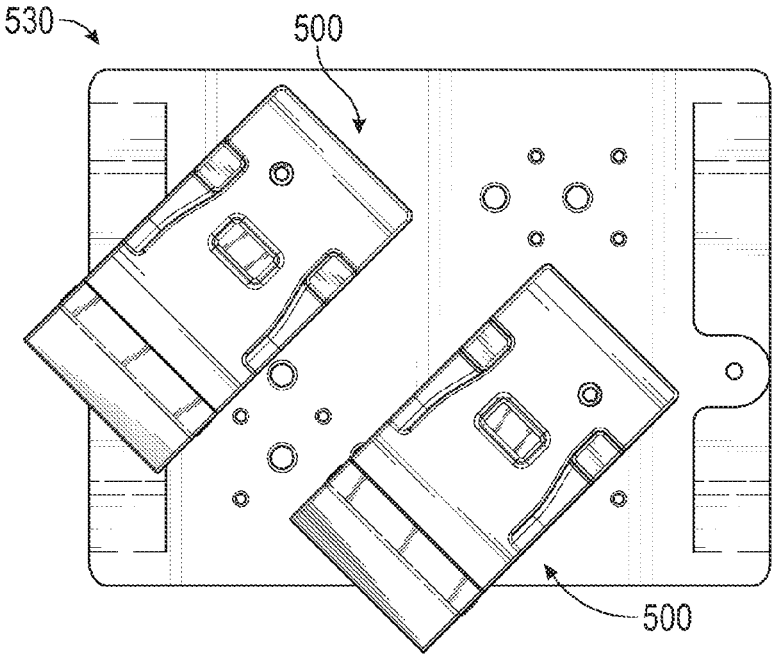

With reference to FIGS. 13-15, a duty belt connecting plate 530 may be worn on a user's belt to carry a pair of firearm magazine loaders 500 in a side-by-side arrangement. The plate 530 includes a plurality of one hand firearm magazine loader coupling areas (e.g., four sets of holes 540, 550, 560, 570 that holes 450*a* of the magazine support housing 140*a* align with for attaching a pair of firearm magazine loaders 500 in a side-by-side arrangement via fasteners 430 (FIG. 5)). FIGS. 14 and 15 show exemplary side-by-side arrangements (e.g., staggered different heights, one up higher than another, both at angle relative to vertical) for holding a pair of firearm magazine loaders 500 with the plate 530. In alternative embodiments, the firearm magazine loaders 500 may include side-by-side arrangements (e.g., both at higher level, both at lower level, one down lower than other, opposite of that shown in FIG. 14) other than those shown. A method of using the firearm magazine loaders 500 with the plate 530 is the same as that in the above-described method of use of the firearm magazine loader 100, except the method is performed successively with each side-by-side one hand firearm magazine loader 500.

Figure 16:
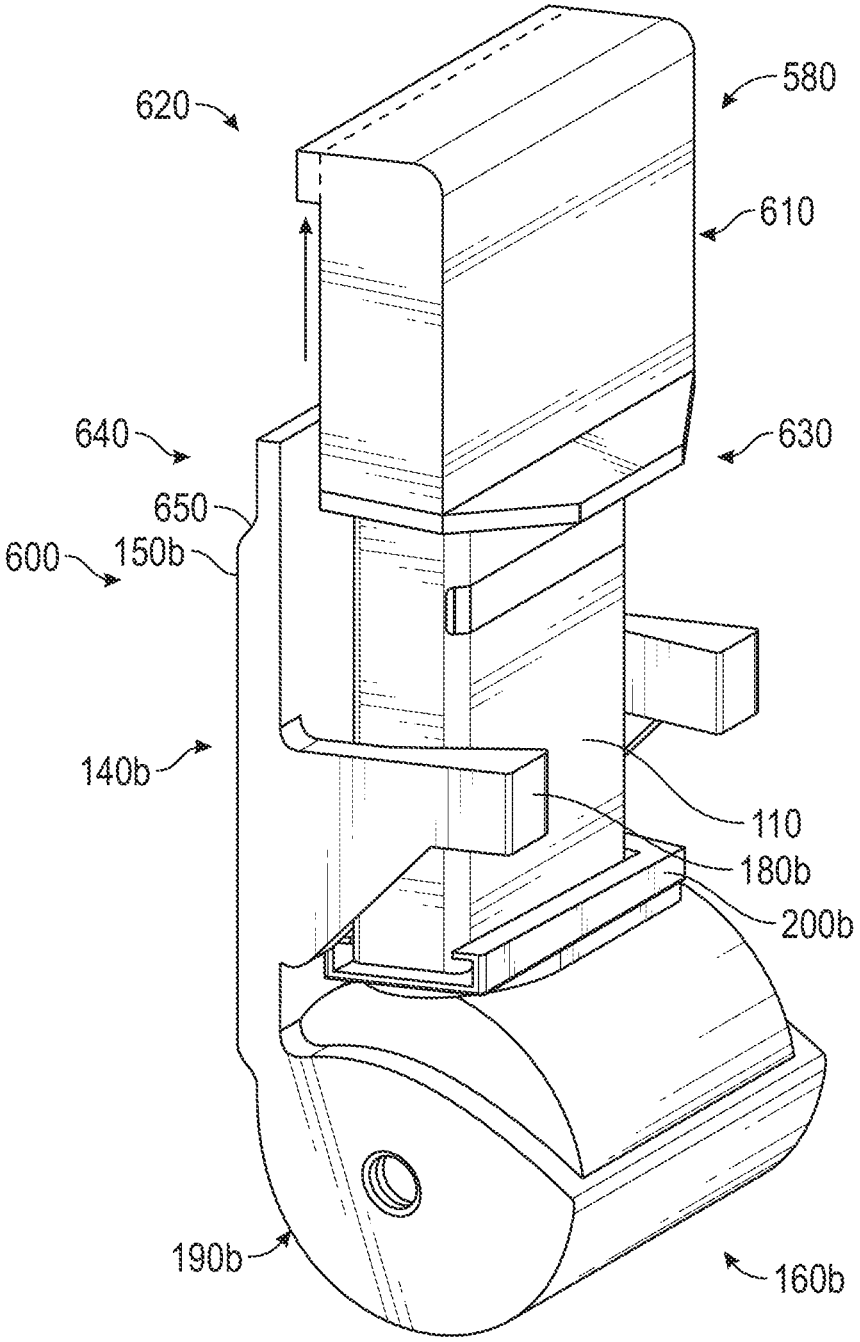
FIG. 16 is a perspective view of a removable cover for a tactical firearm loading device and firearm magazine.

With reference to FIG. 16, a removable download cover 580 is shown for a firearm loader 600, in which like elements to those described above for firearm magazine loaders 100, 500 are shown with like reference numbers, but with a "b" suffix. The above descriptions for the firearm magazine loaders 100, 500 are incorporated herein. The download cover 580 includes a cover section 610, a snap-on section 620, and a lip section 630. The download cover 580 covers the firearm magazine 110 to protect the firearm magazine 110 from dirt, debris, moisture, etc. The download cover 580 is connected to and snaps onto via snap-on section 620 to an upper snap-receiving section 640 (e.g., a protruding member (not shown) on inside of outer wall of snap-on section 620 may be received in recess 650 of rear face of vertical wall 150*b* of the magazine support housing 140*b*). The download cover 580 stops/rests above the rotating cylinder or rotating support 190*b*. The removable download cover 580 is removed by simply placing the firearm handle 130*b* below the lip section 630 and pushing upwards, popping off/removing the removable download cover 580.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment.

Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A one hand firearm magazine loader for loading a firearm with a firearm magazine including a lower member, comprising:

a magazine support housing that terminates in a lower end in a receiving section;

a firearm magazine support extending from the magazine support housing to retain the firearm magazine in a substantially vertical position;

a rotating support rotatably received in the receiving section for rotation about a first axis between the substantially vertical position and an angled position;

a magazine receiving member carried by the rotating support, the magazine receiving member receiving the lower member of the firearm magazine, wherein the magazine receiving member is rotatably mounted to the rotating support for rotation about a second axis, substantially perpendicular to the first axis, of the firearm magazine with mounted firearm.

2. The one hand firearm magazine loader of claim 1, further including a ratchet mechanism between the magazine receiving member and the rotating support, creating a ratcheting effect when rotating the magazine receiving member.

3. The one hand firearm magazine loader of claim 1, wherein the magazine receiving member rotates about the second axis to a downwardly angled position relative to the rotating support.

4. The one hand firearm magazine loader of claim 1, wherein the magazine receiving member includes top flanges having a thickness t that allow a bottom of a handle of the firearm to fully engage the firearm magazine so that the firearm magazine does not accidentally dislodge from the handle, and the thickness t is no greater than 0.04 inches.

5. The one hand firearm magazine loader of claim 1, wherein the firearm magazine support is spaced a distance H from the magazine receiving member to ensure sufficient momentum when loading the firearm with the firearm magazine, and the distance H is at least 1 3/16 inches.

6. The one hand firearm magazine loader of claim 1, further including a biasing mechanism that urges the rotating support to the vertical position.

7. The one hand firearm magazine loader of claim 1, further including a duty belt connecting plate with a plurality of one hand firearm magazine loader coupling areas to couple a pair of one hand firearm magazine loaders to the duty belt connecting plate in a side-by-side arrangement.

8. The one hand firearm magazine loader of claim 7, wherein the side-by-side arrangement includes the pair of one hand firearm magazine loaders staggered at different heights.

9. The one hand firearm magazine loader of claim 7, wherein the side-by-side arrangement includes the pair of one hand firearm magazine loaders oriented at angles relative to vertical.

10. The one hand firearm magazine loader of claim 1, further including a removable download cover that removably covers the firearm magazine and couples to the one hand firearm magazine loader.

11. The one hand firearm magazine loader of claim 10, wherein the removable download cover and one hand firearm magazine loader include a snap-on coupling to couple the removable download cover to the one hand firearm magazine loader.

12. The one hand firearm magazine loader of claim 10, wherein the removable download cover includes a lip section that is configured to be engaged by a handle of the firearm for removing the removable download cover.

13. A method of using a one hand firearm magazine loader for loading a firearm with a firearm magazine including a lower member, the one hand firearm magazine loader comprising magazine support housing that terminates in a lower end in a receiving section, a firearm magazine support extending from the magazine support housing to retain the firearm magazine in a substantially vertical position, a rotating support rotatably received in the receiving section for rotation about a first axis between the substantially vertical position and an angled position, a magazine receiving member carried by the rotating support, the magazine receiving member receiving the lower member of the firearm magazine, wherein the magazine receiving member is rotatably mounted to the rotating support for rotation about a second axis, substantially perpendicular to the first axis, of the firearm magazine with mounted firearm, comprising:

using one hand, right or left, and placing a barrel of the firearm onto the magazine with the rotating support, magazine receiving member and firearm magazine in the substantially vertical position until a bottom of the barrel is stopped by the firearm magazine support;

using the same hand to rotate the rotating support, magazine receiving member, firearm magazine, and firearm away from the substantially vertical position;

moving the barrel of the firearm onto the firearm magazine so that the firearm magazine is fully inserted into the firearm;

using the same hand to rotate the magazine receiving member about the second axis relative to the rotating support and move the firearm, sliding it off the magazine receiving member, locked and loaded ready to fire, all with the same hand.

14. The method of claim 13, wherein using the same hand includes rotating the magazine receiving member about the second axis relative to the rotating support to a downwardly angled position relative to the rotating support.

15. The method of claim 13, further including a biasing mechanism that urges the rotating support to the vertical position, and the method further includes urging the rotating support to the vertical position with the biasing mechanism.

16. The method of claim 13, further including a duty belt connecting plate with a plurality of one hand firearm magazine loader coupling areas to couple a pair of one hand firearm magazine loaders to the duty belt connecting plate in a side-by-side arrangement, and method includes performing the method successively with each side-by-side one hand firearm magazine loader.

17. The method of claim 16, wherein the side-by-side arrangement includes the pair of one hand firearm magazine loaders staggered at different heights, and method includes performing the method successively with each staggered height one hand firearm magazine loader.

18. The method of claim 16, wherein the side-by-side arrangement includes the pair of one hand firearm magazine loaders oriented at angles relative to vertical, and method includes performing the method successively with each angled one hand firearm magazine loader.

19. The method of claim 16, further including a removable download cover that removably covers the firearm magazine and couples to the one hand firearm magazine loader, and the method includes covering the firearm magazine and coupling to the one hand firearm magazine loader with the removable download cover.

20. The method of claim 19, wherein the removable download cover includes a lip section that is configured to be engaged by a handle of the firearm for removing the removable download cover, and the method includes engaging the lip section of the removable download cover with the handle of the firearm and removing the removable download cover.

* * * * *